United States Patent [19]

Minemura et al.

[11] 4,303,706

[45] Dec. 1, 1981

[54] PROCESS FOR THE PREPARATION OF SUEDE-LIKE RAISED FABRIC

[75] Inventors: Norihiro Minemura, Takatsuki; Takeo Kimura, Ibaraki, both of Japan

[73] Assignee: Teijin Limited, Osaka, Japan

[21] Appl. No.: 158,756

[22] Filed: Jun. 12, 1980

[30] Foreign Application Priority Data

Jun. 15, 1979 [JP] Japan ..... 54-74581

[51] Int. Cl.[3] ..... B32B 7/00; B05D 3/02; D04H 1/58; B32B 27/00

[52] U.S. Cl. ..... 427/381; 28/162; 427/393.2; 156/72; 156/148; 156/250; 428/91; 428/253; 428/259; 428/278; 428/288; 428/290

[58] Field of Search ..... 428/91, 253, 257, 258, 428/259, 278, 373, 398, 288, 290; 427/381, 389.9, 393.2; 28/162; 156/72, 148, 250

[56] References Cited

U.S. PATENT DOCUMENTS

| | | | |
|---|---|---|---|
| 3,087,837 | 4/1963 | Van Loo et al. | 428/290 X |
| 3,979,532 | 9/1976 | Muck et al. | 428/91 X |
| 4,109,038 | 8/1978 | Hayashi et al. | 428/91 |

*Primary Examiner*—Michael R. Lusignan
*Attorney, Agent, or Firm*—Sughrue, Mion, Zinn, Macpeak and Seas

[57] ABSTRACT

A process for the preparation of a suede-like raised fabric which comprises preparing a raised fabric which has naps consisting of extra fine fibers (0.0001 to 0.8 denier), applying an emulsion of amino resin to the raised fabric, and after drying, heat-treating the applied raised fabric at 100° to 180° C. to let the amino resin in the fabric harden.

3 Claims, No Drawings

PROCESS FOR THE PREPARATION OF SUEDE-LIKE RAISED FABRIC

BACKGROUND OF THE INVENTION

1. Field of the Invention

The present invention relates to a process for the preparation of a suede-like raised fabric. More particularly, the present invention has reference to a process for preparing a suede-like fabric by applying an amino resin to a raised fabric which has naps consisting of extra fine fibers.

2. Description of the Prior Art

Means for preparing a suede-like raised fabric by application of an elastic resin such as polyurethane, etc. to a raised nonwoven, woven or knitted fabric having naps of extra fine fibers have hitherto been publicly known. Since the resultant suede-like raised fabrics have outstanding properties of an excellent writing effect, bending resilience, crease resistance, etc., they are widely used as a substitute material for natural suede or material for apparel fashions. However, as the diversification of users' taste develops, the need for a product which has the feeling different from that of conventional suede-like raised fabrics prepared by the application of an elastic resin such as polyurethane, etc. has become prevalent.

SUMMARY OF THE INVENTION

The present inventors made a searching investigation as to the resins which can be applied to a raised fabric having naps consisting of extra fine fibers in the place of an elastic resin such as polyurethane, etc. As a result of such elaborate investigation, the present inventors have found that the use of a thermosetting amino resin gives not only an excellent elastic resilience and crease resistance but also excellent feeling resulting from good bending stiffness, which is not seen with raised fabric products treated with an elastic resin such as polyurethane, etc., to a raised fabric and completed the present invention.

More particularly, the present invention provides a process for preparing a suede-like raised fabric which comprises; preparing a raised fabric which has naps consisting of extra fine fibers whose monofilament fineness is in the range of 0.0001 to 0.8 denier; applying an emulsion of amino resin to the raised fabric; and, after drying, heat-treating the applied raised fabric at a temperature of 100° to 180° C. to let the amino resin in the fabric harden.

DESCRIPTION OF THE PREFERRED EMBODIMENTS

Extra fine fibers having monofilament fineness in the range of 0.0001 to 0.8 denier to be used in the present invention can be any of publicly known fibers. To adduce examples, there are, for instance, (1) extra fine fibers obtained by means of generally known super drawing or high speed spinning, (2) extra fine fibers obtained from the islands-in-sea type composite fiber of melt-blend spun composite fiber consisting of two different kinds of polymers by dissolving and removing the sea component after the fabric is formed, and (3) extra fine fibers obtained from multilayer type composite fiber, in which each layer is bonded together, consisting of two different kinds of polymers by mechanically dividing and separating into the respective polymer components or by dissolving and removing one of the polymers after the fabric is formed. As for the polymers for forming extra fine fibers, synthetic polymers including polyester such as polyethylene terephthalate, polyamide such as nylon 6 and nylon 66, and polyacrylonitrile are especially preferable. The fineness of the extra fine fibers is from 0.0001 to 0.8 denier, preferably from 0.001 to 0.6 denier, and more preferably from 0.01 to 0.5 denier. When the denier is less than 0.0001, the surface abrasion and pilling resistance of the raised fabric are not good and when the denier is more than 0.8, the feeling of the raised fabric tends to be rough and a suede-like touch is hardly obtained, both being not desirable.

What is referred to as a fabric in the present invention includes nonwoven, woven, and knitted fabrics or their combinations and a raised fabric means a fabric which has naps consisting of extra fine fibers on the surface of the fabric. A raised fabric according to the present invention is prepared by a single use of said extra fine fibers or by a combined use of extra fine fibers together with other polyester fibers, polyamide fibers, or polyacrylonitrile fibers of the ordinary fineness (of 1 denier or more).

For instance, a raised fabric (nonwoven) of the present invention is obtained directly from the nonwoven fabric prepared according to a publicly known method from staples obtained from extra fine fibers referred to in the aforementioned (1), and in case where staples of extra fine fibers prepared according to the aforementioned (2) are used, a raised fabric (nonwoven) of the present invention is obtained by treating the nonwoven fabric with a solvent of sea component polymer, and further in case where staples of extra fine fibers prepared according to the aforementioned (3) are used, a raised fabric (nonwoven) of the present invention is obtained by raising or buffing the surface of the nonwoven fabric. A raised woven fabric is obtained by preparing a satin fabric from a spun yarn or multifilament yarn consisting of the extra fine fibers as a weft and a spun yarn, multifilament yarn, or crimped yarn consisting of fibers of ordinary fineness as a warp and by raising the surface of thus prepared woven fabric (combined with a process of dissolving and removing the sea component polymer, as the case may be). A double-faced raised woven fabric can be obtained by preparing a double-faced woven fabric whose both surfaces are satin structure and then raising both surfaces. A raised knitted fabric can be obtained by preparing a warp knit fabric with a spun yarn or multifilament yarn of extra fine fibers as a front yarn and a spun yarn, multifilament yarn, or crimped yarn consisting of fibers of ordinary fineness as a back yarn and then by raising the surface of thus obtained knitted fabric.

In the present invention, a raised fabric thus obtained is dyed or printed according to an ordinary method and is further subjected to shearing and/or brushing process as the case may require. Then the dyed or printed raised fabric is given an amino resin.

Amino resins as referred to in the present invention include those resins obtained by addition condensation of formalin with amino groups, and to be more concrete, they are melamine resin, modified melamine resins (etherified melamine resin, etc.), urea resin, thiourea resin, and modified urea resins (etherified urea resin, esterified urea resin, ethyleneurea resin, etc.). These resins have a merit from the viewpoint of commercialization that they are less expensive than polyurethane.

Of them all, melamine resin is especially preferable. These resins are usually used in the form of an emulsion having a concentration of 0.1 to 30% by weight. As for the methods of applying an emulsion of amino resin, any of impregnating method, coating method, and spraying method is available; however, the method of coating the reverse surface of the raised fabric (the surface not raised or less raised) with the emulsion is especially preferable. The amount of amino resin (in dry amount) to be applied is preferably 0.1 to 10% by weight based on the weight of the raised fabric and it is especially preferable to adjust the amount to 0.5 through 5% by weight.

The raised fabric applied with an emulsion of amino resin is then dried and heat-treated. The drying is usually carried out at 60° to 120° C. for 1 to 15 minutes and is followed by heat-treatment which is conducted at 100° to 180° C. for 10 seconds to 15 minutes. In the drying process the moisture contained in the raised fabric (arising from the emulsion) is removed and in the next process of heat-treatment the amino resin hardens as a result of the three-dimensional cross linking reaction which takes place in the raised fabric. Since the three-dimensional cross linking reaction is promoted by the presence of a catalyst such as organic tin compounds and organic amine compounds, it is preferable to have such catalyst added to said emulsion beforehand. The suede-like raised fabric thus obtained may later have its one or both surfaces buffed and/or brushed, if needed. Further in the present invention, any of such processes as water repellent finish, oil repellent finish, soil resistant finish, antistatic finish, softening finish, flame retardant finish, etc. may be effected at the same time with, before, or after the treatment with an emulsion of amino resin.

Since the suede-like raised fabric obtained according to the present invention has excellent properties of bending resilience, crease resistance, writing effect and the like and also has an excellent feeling arising from good bending stiffness, it has wide varieties of use as clothing, for example, jackets, jumpers, blazers, skirts, trousers, shorts, slacks, dresses, suits, vests, coats, gloves and belts, and other sundries such as bags, boots, and upholsteries.

The following examples illustrate the present invention in detail. In the examples, percent is % by weight.

EXAMPLE 1

(1) Preparation of a raised woven fabric having naps consisting of extra fine fibers According to the method disclosed in BE No. 870167 (granted on Sept. 29, 1978), a tubular hollow composite fiber having a total fineness of 2.1 deniers, wherein the respective polyethylene terephthalate segments had a fineness of 0.09 denier, was prepared, in which composite fiber the polyethylene terephthalate segments and polystyrene segments making a total of 32 segments were arranged side by side loopwise, extending along the longitudinal axis of the fiber to form a tubular body and having polyethylene terephthalate segments and polystyrene segments at the weight ratio of 70 to 30.

A double-faced 5-ply satin weave was prepared with a single twist yarn of multifilament yarn (190 deniers/90 filaments) of this tubular hollow composite fiber having a twist number of S 250 T/m used as a weft yarn and a wooly yarn (false twisted) of polyethylene terephthalate (75 deniers/24 filaments) having a twist number of S 200 T/m used as a warp yarn.

The obtained woven fabric was first relaxed at 98° C. in the hot water bath for 30 minutes and was then dried at 120° C. for 3 minutes. After that, the woven fabric was washed with trichloroethylene five times to substantially dissolve and remove all the polystyrene components of the tubular hollow composite fiber. Thereafter, the woven fabric was dried and an oiling agent mainly consisting of mineral oil was applied to the dried woven fabric. Then the surface of the woven fabric was raised 20 times with a wire raising machine at a running speed of 30 meters/minute and the reverse side of the woven fabric was raised 10 times likewise to provide a double-faced raised woven fabric having naps consisting of extra fine fibers (0.09 denier).

The double-faced raised woven fabric thus obtained was preheat set at a temperature of 170° C. for 30 seconds using a pin tenter type heat setter. After that, the fabric was dyed at a temperature of 130° C. for 60 minutes in an aqueous dyeing bath containing 4% (based on the weight of the fabric) of Duranol Blue G (C.I. No. 63305, trade name for a disperse dye manufactured by I.C.I.), 0.2 ml/l of acetic acid, and 2 g/l of a dispersing agent mainly consisting of a condensation product of naphthalene sulfonic acid with formaldehyde. The woven fabric was then subjected to soaping at a temperature of 80° C. for 20 minutes with the use of an aqueous solution containing a nonionic detergent and was dried at a temperature of 120° C. for 3 minutes.

(2.) Preparation of suede-like raised woven fabric

The raised and dyed double-faced woven fabric was immersed in a 1% emulsion of water repellent of fluorine type (trade name: Asahi Guard AG-730, manufactured by Asahi Glass Co., Ltd.), squeezed to a pick-up ratio of 75% based on the weight of the fabric, and dried at 120° C. for 3 minutes. Thereafter, the reverse side (which had been raised 10 times) of the double-faced raised woven fabric was coated with a 3.8% emulsion (containing a 10% organic amine cross-linking catalyst based on the resin) of melamine resin (trade name: Sumitex Resin M-3, manufactured by Sumitomo Chemical Co., Ltd.) with the use of 45-mesh gravure rolls in such a way as to have a coating amount (in dry weight) of 1.5% based on the weight of the woven fabric. The raised woven fabric was dried at a temperature of 120° C. for 3 minutes and was then heat-treated at 150° C. for 30 seconds to obtain a suede-like raised woven fabric. The obtained suede-like raised woven fabric had not only an excellent writing effect, bending resilience, crease resistance, etc. but also excellent feeling resulting from good bending stiffness different from a raised woven fabric applied with polyurethane.

EXAMPLE 2

The dyed double-faced raised woven fabric obtained in Example 1 was immersed in a 2% emulsion of urea resin (trade name: Sumitex Resin ULW, manufactured by Sumitomo Chemical Co., Ltd.) (containing a 6% organic amine cross-linking catalyst based on the resin), squeezed to a pick-up ratio of 75%, dried at a temperature of 120° C. for 3 minutes, and then heat-treated at a temperature of 150° C. for 30 seconds. After that, both surfaces of the raised woven fabric were buffed once with a roller sander machine having 100-mesh sand paper to obtain a suede-like raised woven fabric. The obtained suede-like raised woven fabric had an excellent writing effect, bending resilience, crease resistance and outstanding feeling resulting from good bending stiffness.

EXAMPLE 3

(1) Preparation of a raised woven fabric having naps consisting of extra fine fibers Tubular hollow composite fibers were prepared according to a method disclosed in U.S. Pat. No. 4,109,038 (issued on Aug. 22, 1978), each composite fiber being composed of 16 segments alternately arranged side by side loopwise consisting of segments of polyethylene terephthalate and poly-ε-capromide (nylon 6) respectively and extending along the longitudinal axis of the fiber to form a tubular body having a size of 3.75 deniers and each segment having a fineness of 0.23 denier.

A 3/1 broken twill fabric was prepared with a single twist yarn of multifilament yarn (300 deniers/80 filaments) of this tubular hollow composite fiber having a twist number of S 150 T/m used as a weft yarn and a single twist yarn of wooly yarn (100 deniers/24 filaments) of polyethylene terephthalate having a twist number of S 200 T/m used as a warp yarn.

The obtained woven fabric was first relaxed at 98° C. in the hot water bath for 30 minutes and was then dried at 120° C. for 3 minutes. After an oiling agent mainly consisting of mineral oil was applied to the woven fabric, the surface of the woven fabric was raised 20 times with a wire raising machine at a running speed of 30 meters/minute and was then heat set at a temperature of 170° C. for 30 seconds using a pin tenter type heat setter.

Thereafter, the obtained single-faced raised woven fabric was dyed at a temperature of 130° C. for 60 minutes in an aqueous dyeing bath containing 4% (based on the weight of the fabric) of Duranol Blue G (C.I. No. 63305, trade name for a disperse dye manufactured by I.C.I.), 0.2 ml/l of acetic acid, and 1 g/l of a dispersing agent mainly consisting of a condensation product of naphthalene sulfonic acid with formaldehyde. The woven fabric was then subjected to soaping at a temperature of 80° C. for 20 minutes with the use of an aqueous solution containing a nonionic detergent and was dried at a temperature of 120° C. for 3 minutes.

(2) Preparation of a suede-like raised woven fabric

Melamine resin coating was effected on the reverse side (the surface not raised) of the dyed single-faced raised woven fabric according to Example 1. Thereafter, the raised woven fabric was dried at a temperature of 120° C. for 3 minutes and heat-treated at a temperature of 150° C. for 30 seconds. Then both surfaces of the raised woven fabric were buffed once with a roller sander machine having 100-mesh sand paper to obtain a suede-like raised woven fabric. The obtained suede-like raised woven fabric had an excellent writing effect, bending resilience, crease resistance and outstanding feeling resulting from good bending stiffness.

EXAMPLE 4

A tricot fabric having the weight of 120 g/m$^2$ was knitted with a single twist yarn (S 120 T/m) of multifilament yarn (75 deniers/20 filaments) of tubular hollow composite fiber prepared in Example 3 as a front yarn and a multifilament yarn (30 deniers/12 filaments) of polyethylene terephthalate as a back yarn. The obtained knitted fabric was raised and dyed according to Example 3 to prepare a dyed single-faced raised knitted fabric. Melamine resin was coated on the reverse side (the surface not raised) of this single-faced raised knitted fabric according to Example 1. Thereafter, the raised knitted fabric was dried at a temperature of 120° C. for 3 minutes, heat-treated at a temperature of 150° C. for 30 seconds, and both surfaces of the raised knitted fabric were buffed once with a roller sander machine having 100-mesh sand paper to obtain a suede-like raised knitted fabric. The obtained suede-like raised knitted fabric had an excellent writing effect, bending resilience, crease resistance and outstanding feeling resulting from good bending stiffness.

What is claimed is:

1. A process for the preparation of a suede-like raised fabric which comprises; preparing a raised fabric which has naps consisting of extra fine fibers whose monofilament fineness is in the range of 0.0001 to 0.8 denier; applying an emulsion of a melamine resin to said raised fabric; and, after drying, heat-treating the applied raised fabric at a temperature of 100° to 180° C. to let the melamine resin in the fabric harden.

2. The process for the preparation of a suede-like raised fabric according to claim 1, wherein the application of the melamine resin to the raised fabric is effected by coating the emulsion of the melamine resin on the reverse side of the raised fabric.

3. The process for the preparation of a suede-like raised fabric according to claim 1 or claim 2, wherein the amount of the melamine resin to be applied to the raised fabric is 0.1 to 10% by weight of melamine resin (on a dry basis) based on the weight of the raised fabric.

* * * * *